US011633043B2

(12) United States Patent
Sutula, Jr.

(10) Patent No.: US 11,633,043 B2
(45) Date of Patent: Apr. 25, 2023

(54) LIGHTWEIGHT ADJUSTABLE FOLDING ERGONOMIC SIT/STAND CHAIR WITH OPTIONAL METHODS OF CONSTRUCTION AND INTEGRATION WITH ANCILLARY ACCESSORIES

(71) Applicant: Daniel Paul Sutula, Jr., Harwinton, CT (US)

(72) Inventor: Daniel Paul Sutula, Jr., Harwinton, CT (US)

( * ) Notice: Subject to any disclaimer, the term of this patent is extended or adjusted under 35 U.S.C. 154(b) by 82 days.

(21) Appl. No.: 16/589,075

(22) Filed: Sep. 30, 2019

(65) Prior Publication Data

US 2021/0093089 A1 Apr. 1, 2021

(51) Int. Cl.

| | |
|---|---|
| ***A47C 7/02*** | (2006.01) |
| ***A47C 7/28*** | (2006.01) |
| ***A47C 7/54*** | (2006.01) |
| ***A47C 4/28*** | (2006.01) |

(52) U.S. Cl.

CPC ..... *A47C 7/029* (2018.08); *A47C 4/28* (2013.01); *A47C 7/54* (2013.01)

(58) Field of Classification Search

CPC ..... A47C 4/24; A47C 9/105; A47C 4/286; A47C 7/029; A47C 4/28; A47C 7/54

USPC ..... 297/42, 44, 45, 55, 56

See application file for complete search history.

(56) References Cited

U.S. PATENT DOCUMENTS

| | | | | |
|---|---|---|---|---|
| 1,481,521 A * | 1/1924 | Marsh | A47C 4/286 | 297/56 |
| 2,380,437 A * | 7/1945 | Homrighausen | A61H 3/00 | 297/55 |
| 4,556,249 A * | 12/1985 | Kassai | A47D 1/023 | 297/30 |
| 8,231,171 B2 * | 7/2012 | Leng | A47C 4/24 | 297/56 |

FOREIGN PATENT DOCUMENTS

DE 4027400 A1 * 5/1991

* cited by examiner

*Primary Examiner* — Sarah B McPartlin

(74) *Attorney, Agent, or Firm* — Robert S. Smith

(57) ABSTRACT

A novel lightweight, high stability ergonomic chair, enabling sitting, and leaning in a perched intermediary position between sitting and standing. An inclined saddle type seat is supported by three legs. A forward chair leg is located between the feet of, and beneath the center of gravity of the seated person. Two chair legs extend rearward. The chair permits rocking backwards, diagonally forward, and rocking about the forward chair leg. This "active seating" provides for easy transitions between sitting and standing, shifting of weight, and conveys an open positive body language. Multiple embodiments and architectures are disclosed multiple configurations including; rigid, folding, and for quick disassembly. The chairs may be constructed of various rigid and flexible materials, with optional features including; armrests, footrests, caster wheels, cushioning, and a standing desk type work surface. The chair eliminates the need for connection to a base platform beneath the user's feet.

2 Claims, 17 Drawing Sheets

LIGHTWEIGHT ADJUSTABLE FOLDING ERGONOMIC SIT/STAND CHAIR WITH OPTIONAL METHODS OF CONSTRUCTION AND INTEGRATION WITH ANCILLARY ACCESSORIES

This application is filed claiming Priority Filing Date associated with Application No. 62/739,308 Filing Date Sep. 30, 2018, Confirmation No. 4050

BACKGROUND

The present invention relates to the design of ergonomic sit/stand chairs. The so-called "sit/stand" chairs provide an intermediary "perching" position that is a healthy alternative to sitting or standing. Sit/stand chairs have become popular, particularly in the office and industrial environments, for applications at desks and computer workstations. Sit/stand chairs are considered a subset of ergonomic chairs, with the differentiating features being an elevated seat height, forward sloping seat angle, and the ability to resist leaning loads.

Sit/stand chairs are often referred to as "active seating", since the user is required to support part of their weight with their legs, which is essentially a low-level isostatic exercise, which stimulates blood flow to the legs. From a sit-stand or perching position, the transition to standing position is nearly effortless. The sit/stand posture is not intended as a primary seating position, but rather an alternative to augment sitting and standing.

The sit/stand posture is ideal for professions that require standing attention such as police and security guards, coaches, musicians, artists, draftsmen, trade show exhibitors, and lecturers. For example, salespersons attending tradeshows would benefit greatly as they would eliminate the wasteful and exhausting repetition of the up-down motion required to rise from a conventional chair every time a potential customer passes by. The sit/stand position is also good for people who been seated for extended periods such as air travelers waiting between connecting flights.

PRIOR ART

There are numerous deficiencies associate with the sit/stand chairs identified in the prior art, and this invention serves to address most of these issues in an elegant and novel way. Presently, the use of sit-stand chairs primarily limited to office and manufacturing environments.

Most of the available sit/stand chairs are equipped with large pedestal type bases that are intentionally heavy in order to provide ballast and resistance to tipping. These bases are typically flat and not suitable for rough or uneven surfaces. Other sit-stand chairs feature a flat "floor-like" platform from which the seat support pole is mounted, and on which the user is required to stand while perching. However, if the user lifts their feet off the platform, instability will ensue. Other vertical post-type sit/stand seats utilize a heavy and bulbous base, with a convex surface that enables and encourages a multi-directional rocking motion, which is thus inherently unstable.

The majority of the existing sit/stand seats are not foldable. In addition, some of these designs are unconventional and unusual to the point of appearing awkward. Most of the existing ergonomic and sit/stand chairs are designed specifically for office and industrial environments are almost completely impractical for use elsewhere. Most are unsuitable for applications where weather resistance, weight, fold ability; portability, cost, and style are of import considerations.

The present invention will drastically increase the applications for sit/stand chairs, being more affordability, practical and convenient, enabling utility in home, leisure, and recreational environments.

SUMMARY OF THE INVENTION

The invention comprises ergonomic chair providing a means for sitting in a substantially upright sit/stand position in which the users weight is distributed between their feet and buttocks while perching on an inclined seat, elegantly integrated with a seat and backrest in a unique minimalistic design configuration that is strong, stable, comfortable, economical and promotes a healthy alternative to conventional seating. The three-legged base provides solid stable footing on uneven surface, and with exceptional structural efficiency, the chair lightweight and portable with an aesthetically appealing form which follows the function, this novel invention combines affordability, functionality and utility in myriad applications and environments hitherto impractical with sit/stand chairs of the prior art.

BRIEF DESCRIPTION OF THE DRAWINGS

The advantages, features, and methods of constructing this invention will become more clearly apparent from the following description of several embodiments of the invention, given as non-restrictive examples only and represented in the accompanying drawings in which.

DESCRIPTION OF THE DRAWING LABELS

Figure 4:
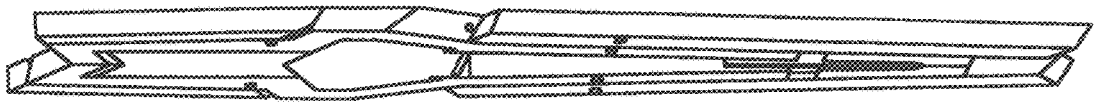
FIG. 4 is a perspective isometric view of the invention of FIG. 1, shown folded into a flat position.
Figure 3:
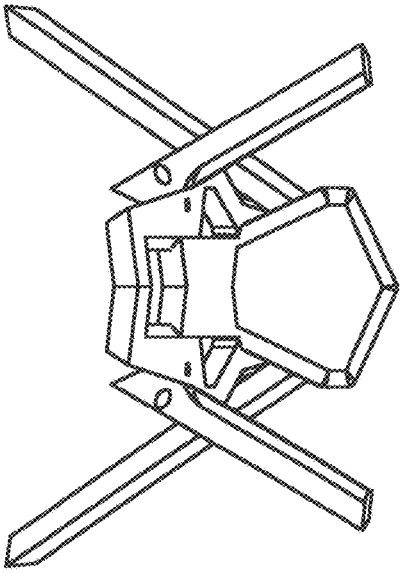
FIG. 3 is a top view of the invention of FIG. 1, shown in an unfolded seating position.
Figure 2:
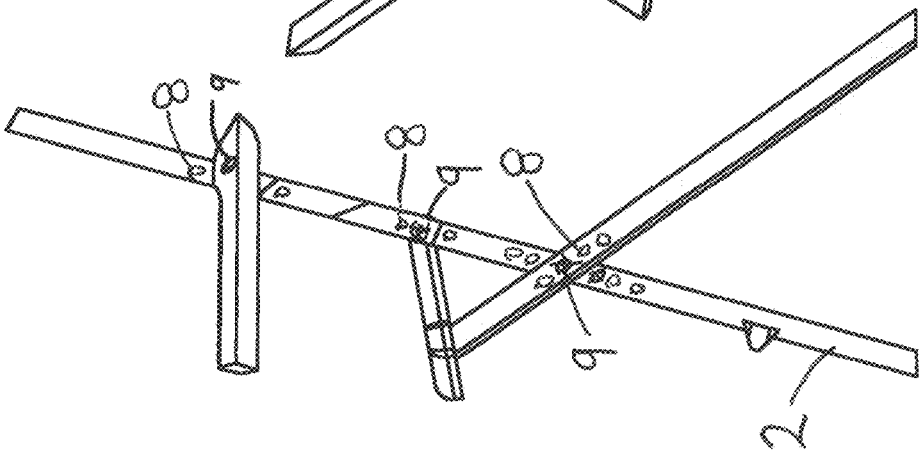
FIG. 2 is a side view of the invention of FIG. 1, shown in an unfolded seating position.
Figure 1:
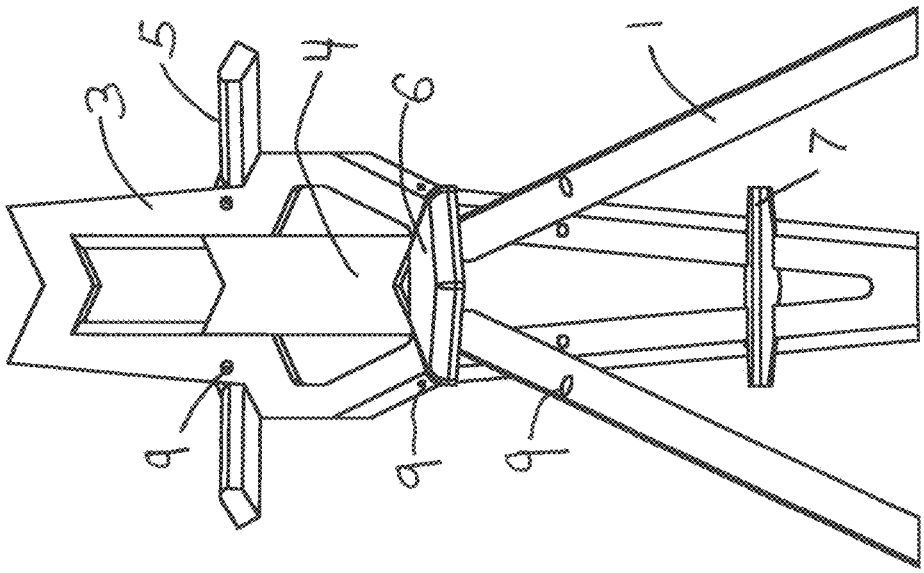
FIG. 1 is a front view of the chair show in unfolded seating position in accordance with the preferred embodiment of this invention, comprising a rigid frame in combination with a seat, arms, and legs, which can fold into a flat configuration.
Figure 7:
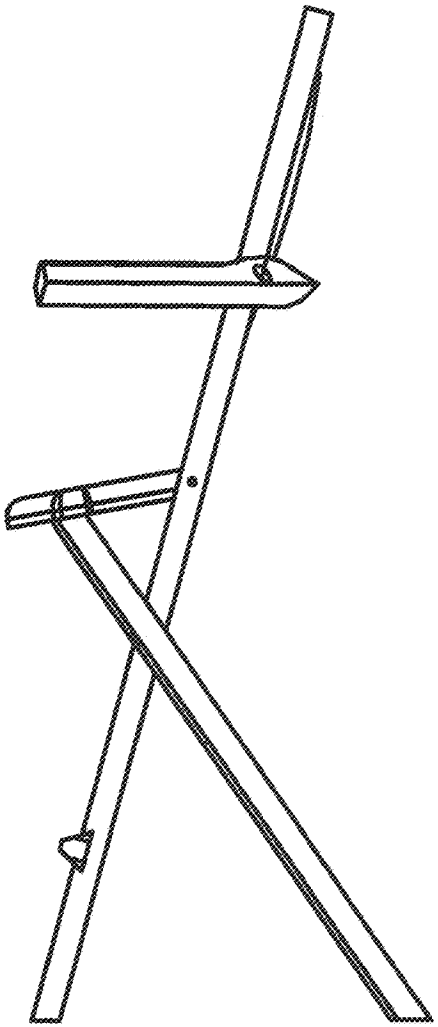
FIG. 7 is a side view of the invention of FIG. 5, shown in an unfolded seating position.
Figure 6:
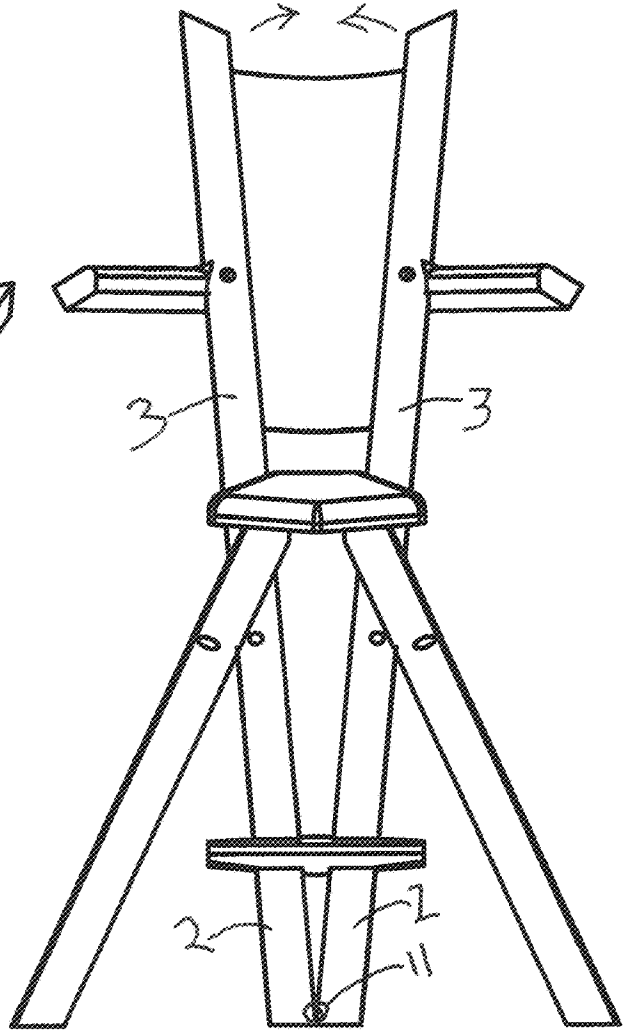
FIG. 6 is a front view of the invention of FIG. 5, shown in an unfolded seating position.
Figure 5:
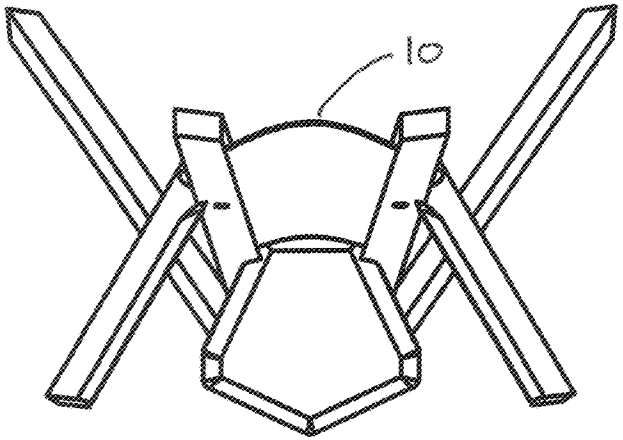
FIG. 5 is a top view of the chair in accordance with an alternate embodiment of this invention, shown in an unfolded seating position, this embodiment comprising folding geometry primarily of "stick" construction.
Figure 9:
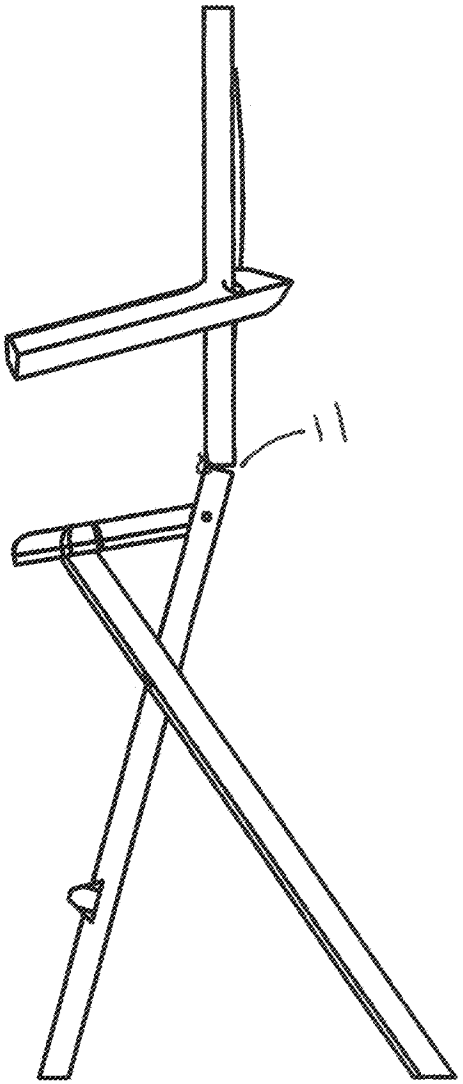
FIG. 9 is side view of the embodiment of FIG. 8, shown in the unfolded seating position.
Figure 8:
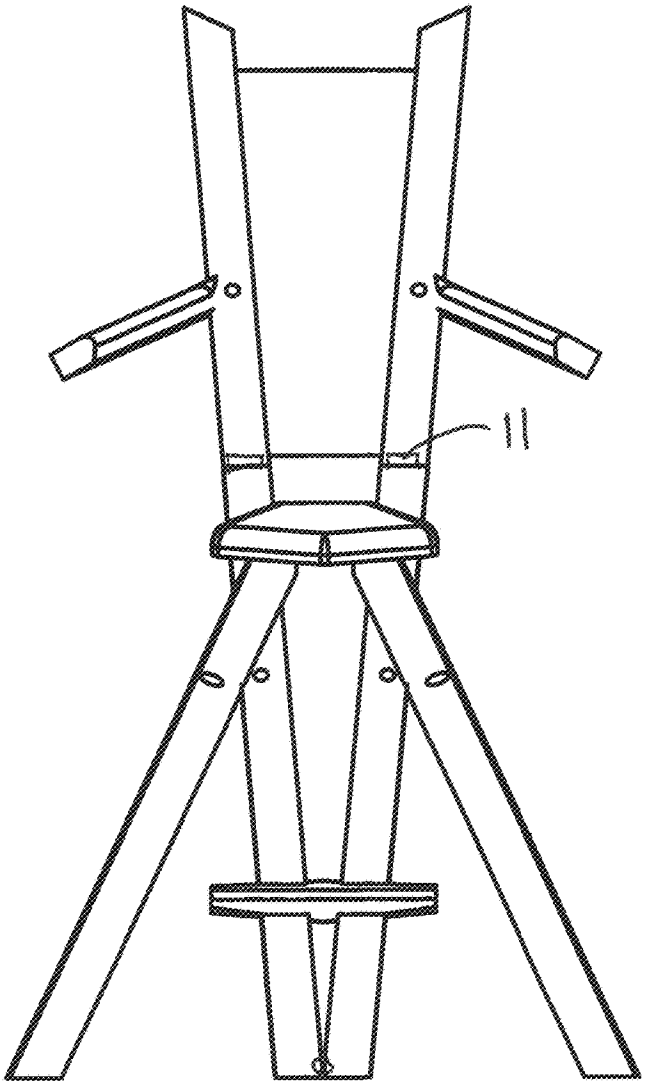
FIG. 8 is a front view of the chair in accordance with another alternate embodiment of this invention, shown in an unfolded seating position, this embodiment comprising further adjustable and folding geometry primarily of "stick" construction.
Figure 10:
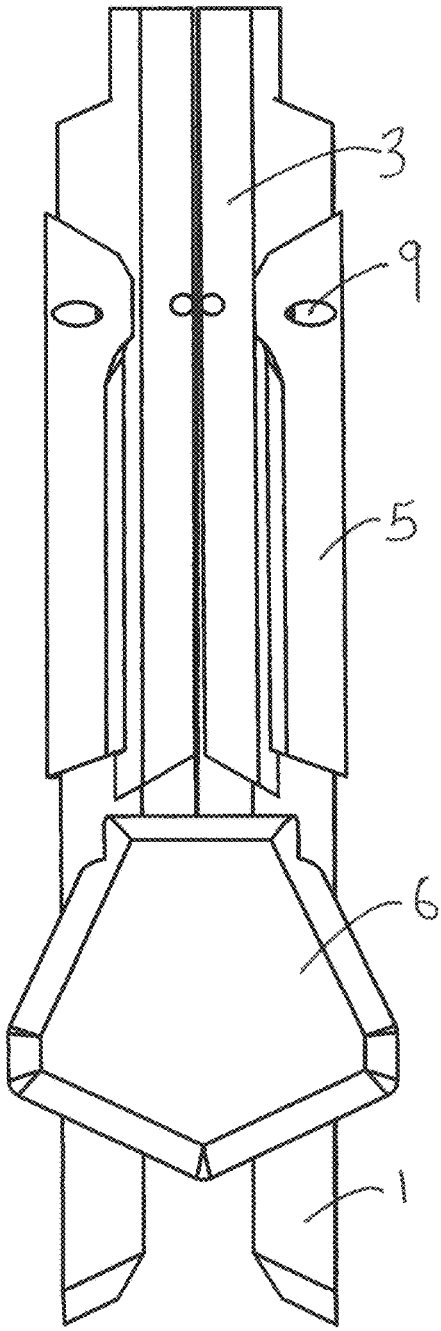
FIG. 10 is a front view of the embodiment of FIG. 8, shown in the folded position.
Figure 11:
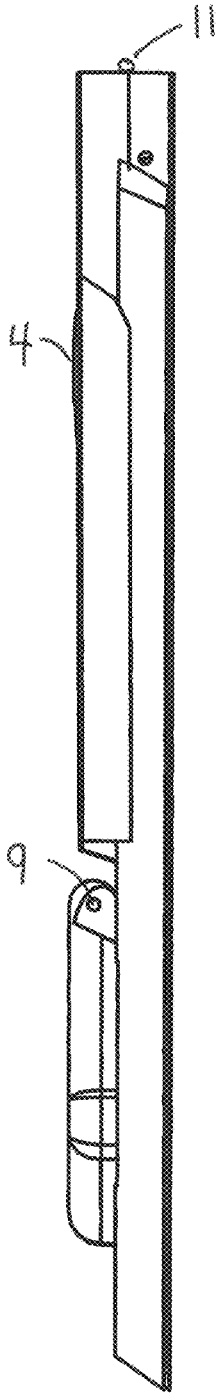
FIG. 11 is a side view of the embodiment of FIG. 8 shown in the folded position.
Figure 12:
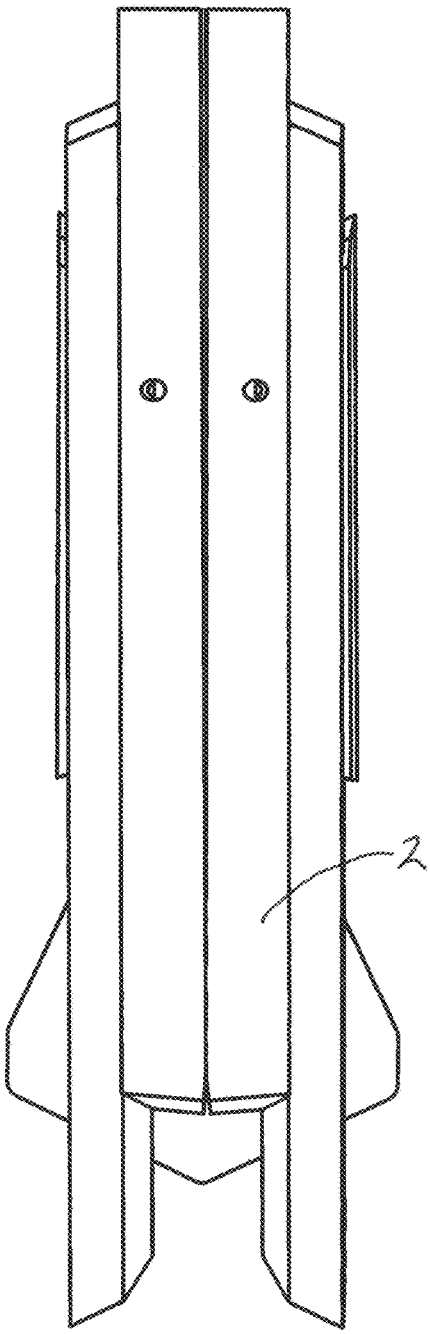
FIG. 12 is a back view of the embodiment of FIG. 8, shown in the folded position.
Figure 15:
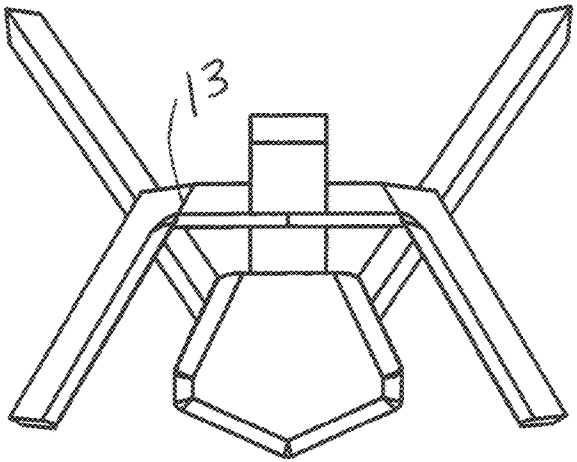
FIG. 15 is a top view of the embodiment of FIG. 13.
Figure 14:
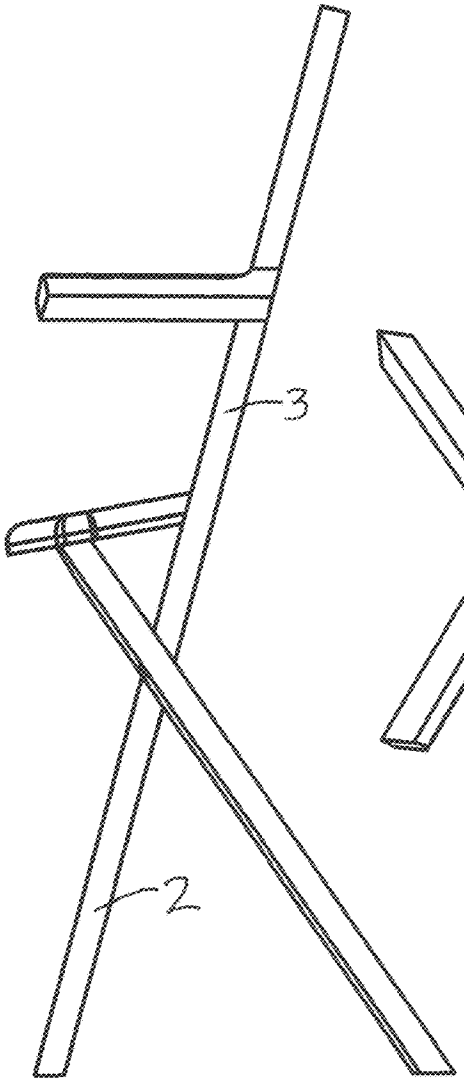
FIG. 14 is a side view of the embodiment of FIG. 13.
Figure 13:
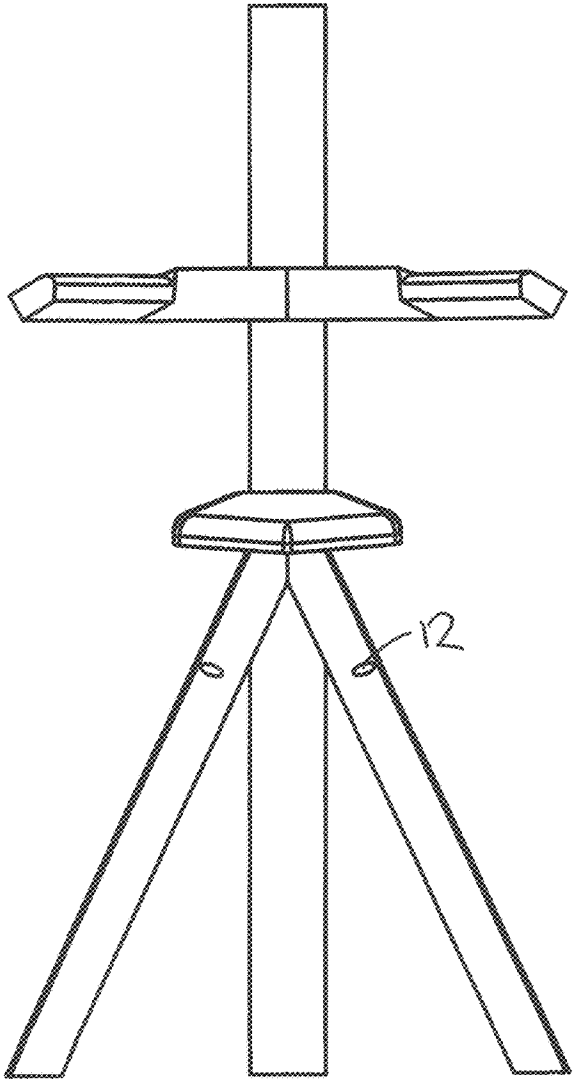
FIG. 13 is a front view of the chair in accordance with another alternate embodiment of this invention, this embodiment comprising rigid non-foldable geometry.
Figure 18:
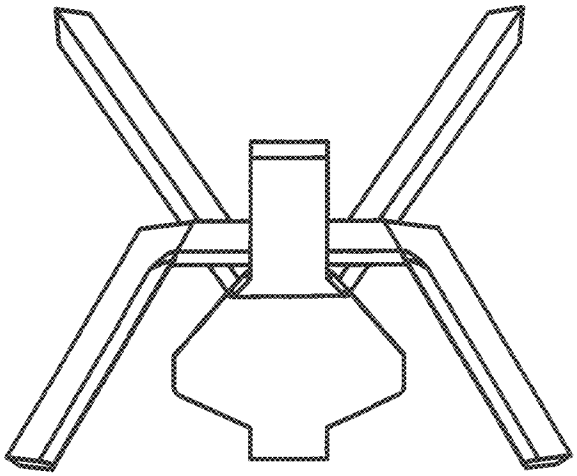
FIG. 18 is a top view of the embodiment of FIG. 16.
Figure 17:
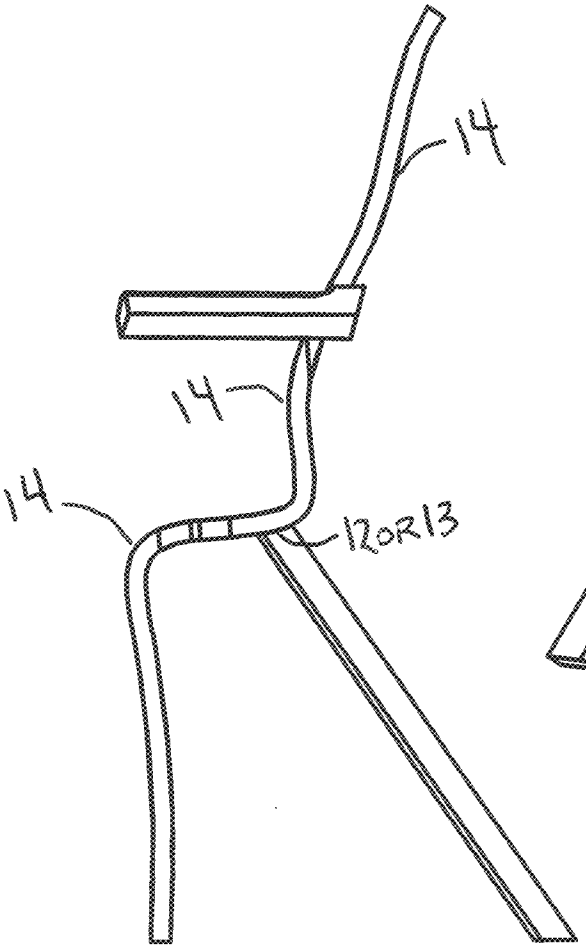
FIG. 17 is a side view of the embodiment of FIG. 16.
Figure 16:
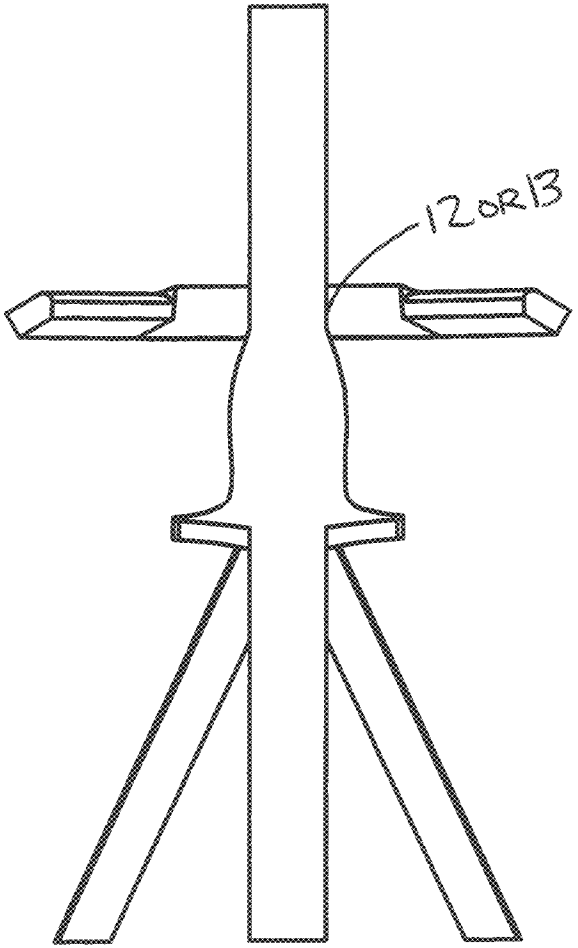
FIG. 16 is a front view of the chair in accordance with another alternate embodiment of this invention, this embodiment comprising rigid non-foldable geometry with integrated and contoured members.
Figure 19:
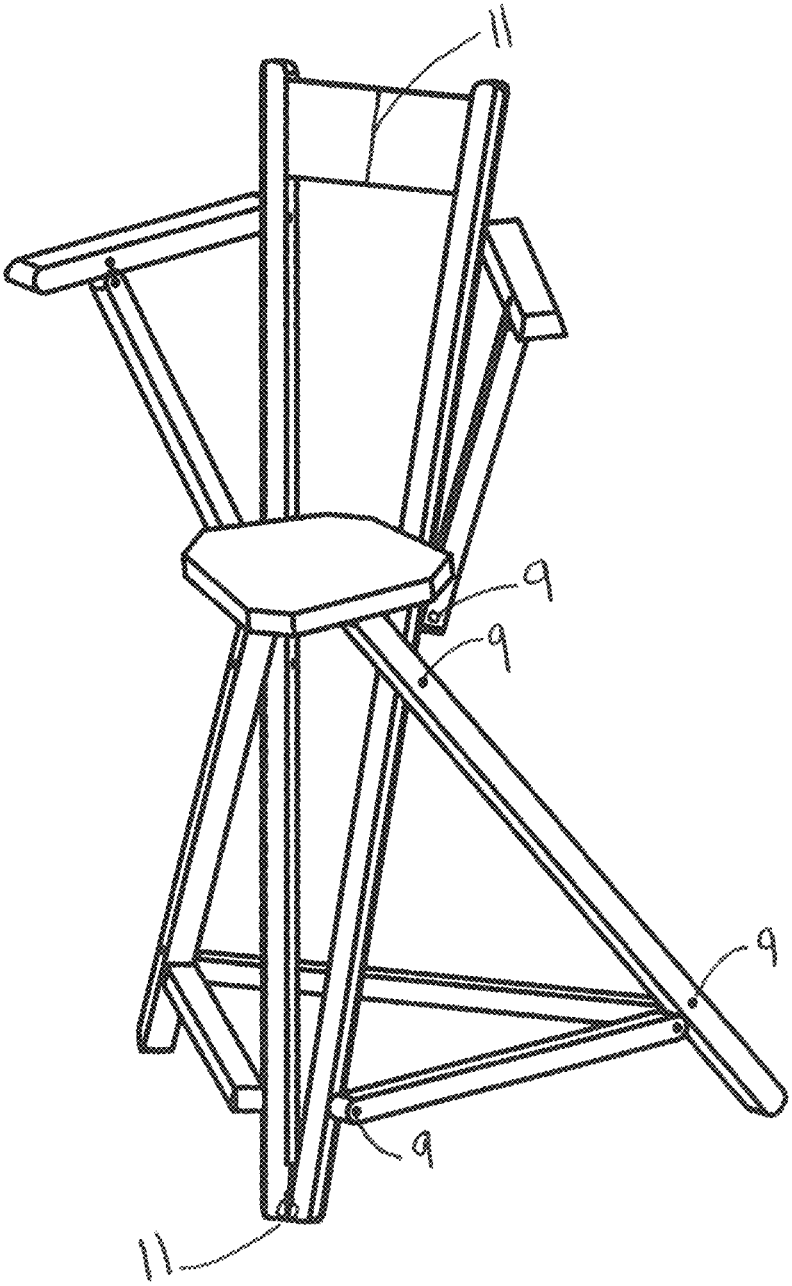
FIG. 19 is a perspective isometric view of the chair in accordance with another alternate embodiment of this invention, this embodiment comprising a foldable geometry comprising primarily "stick" type construction.
Figure 22:
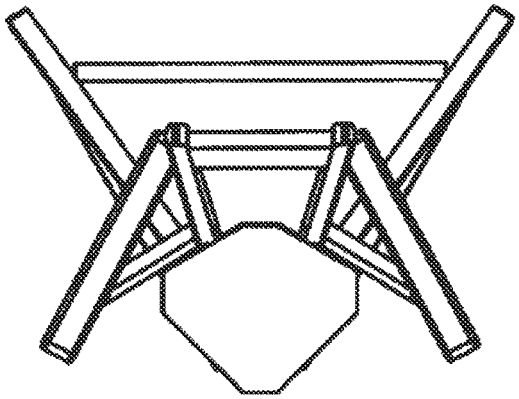
FIG. 22 is a top view of the embodiment of FIG. 28.
Figure 24:
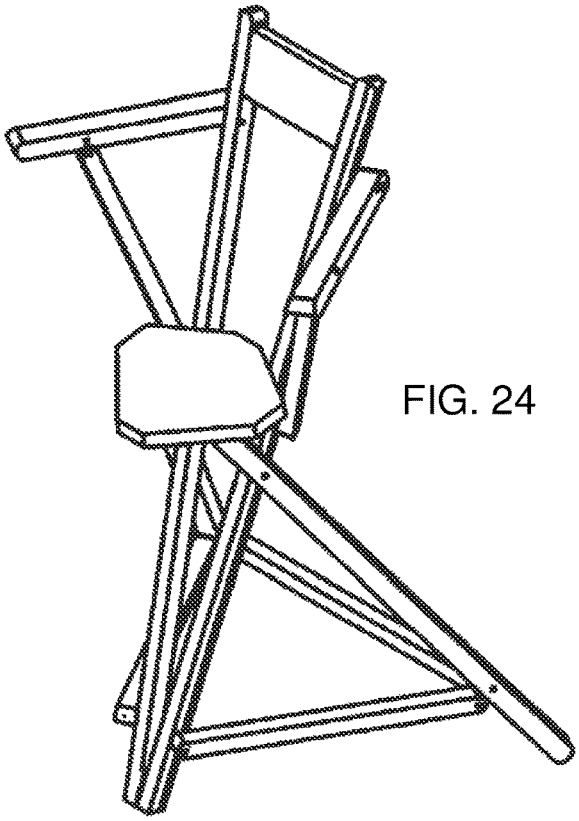
FIG. 24 is another isometric view of the embodiment of FIG. 28.
Figure 20:
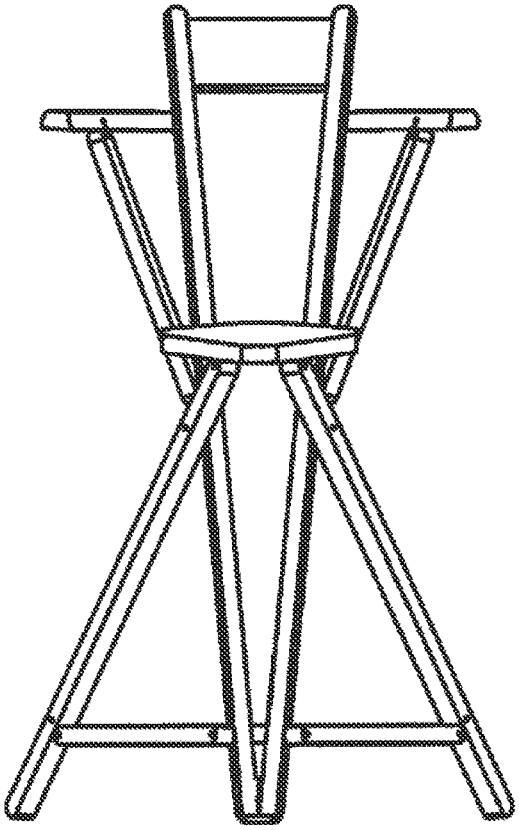
FIG. 20 is a front view of the embodiment of FIG. 28.
Figure 21:
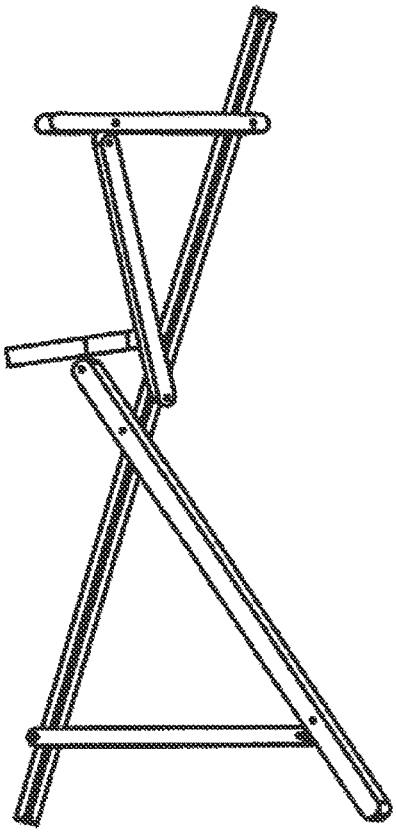
FIG. 21 is a side view of the embodiment of FIG. 28.
Figure 23:
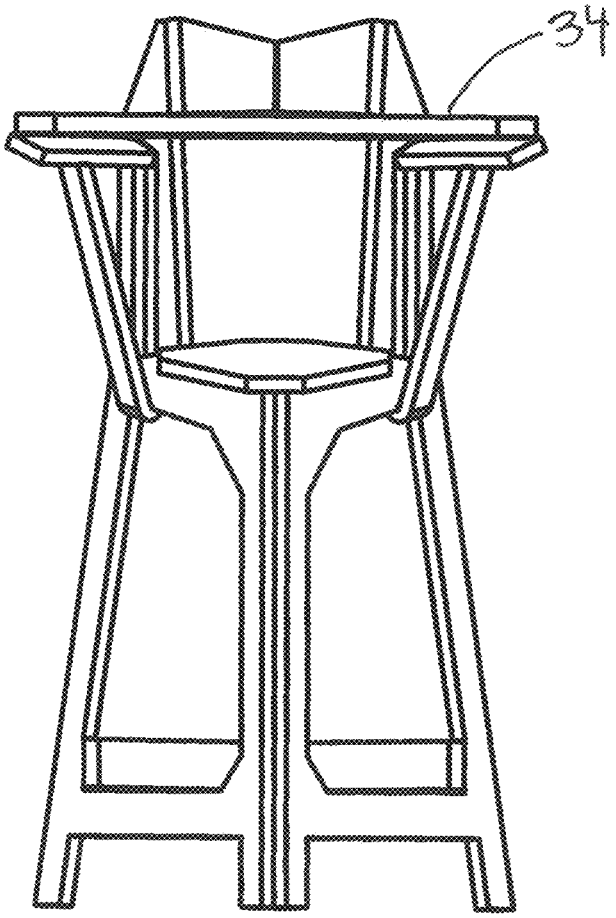
FIG. 23 is a front view of an alternate, further comprising an optional desk type work surf ace supported by the armrests of the chair.
Figure 25:
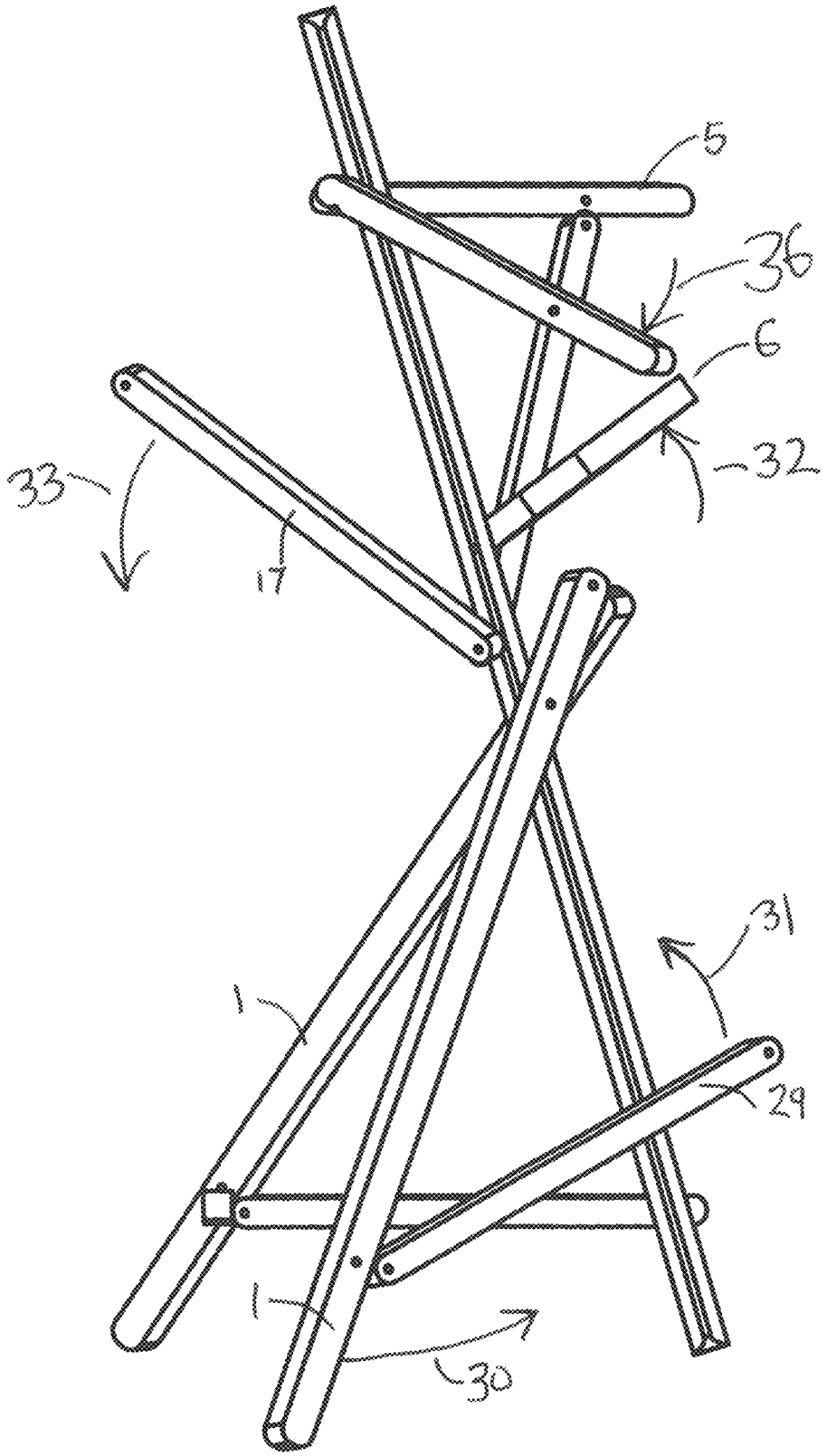
FIG. 25 is a side view of the embodiment of FIG. 19, showing the chair in an intermediary folding position along with the directions of motion required for folding.
Figure 26:
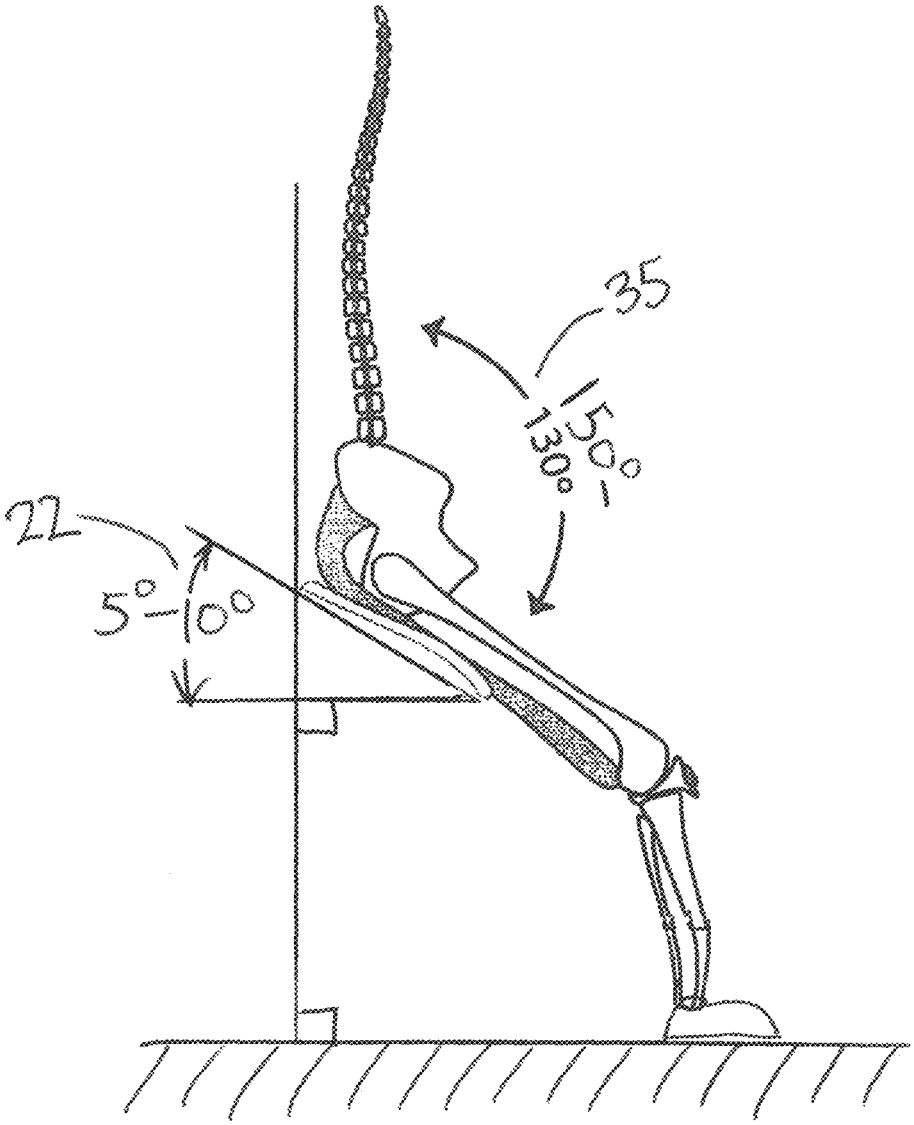
Figure 27:
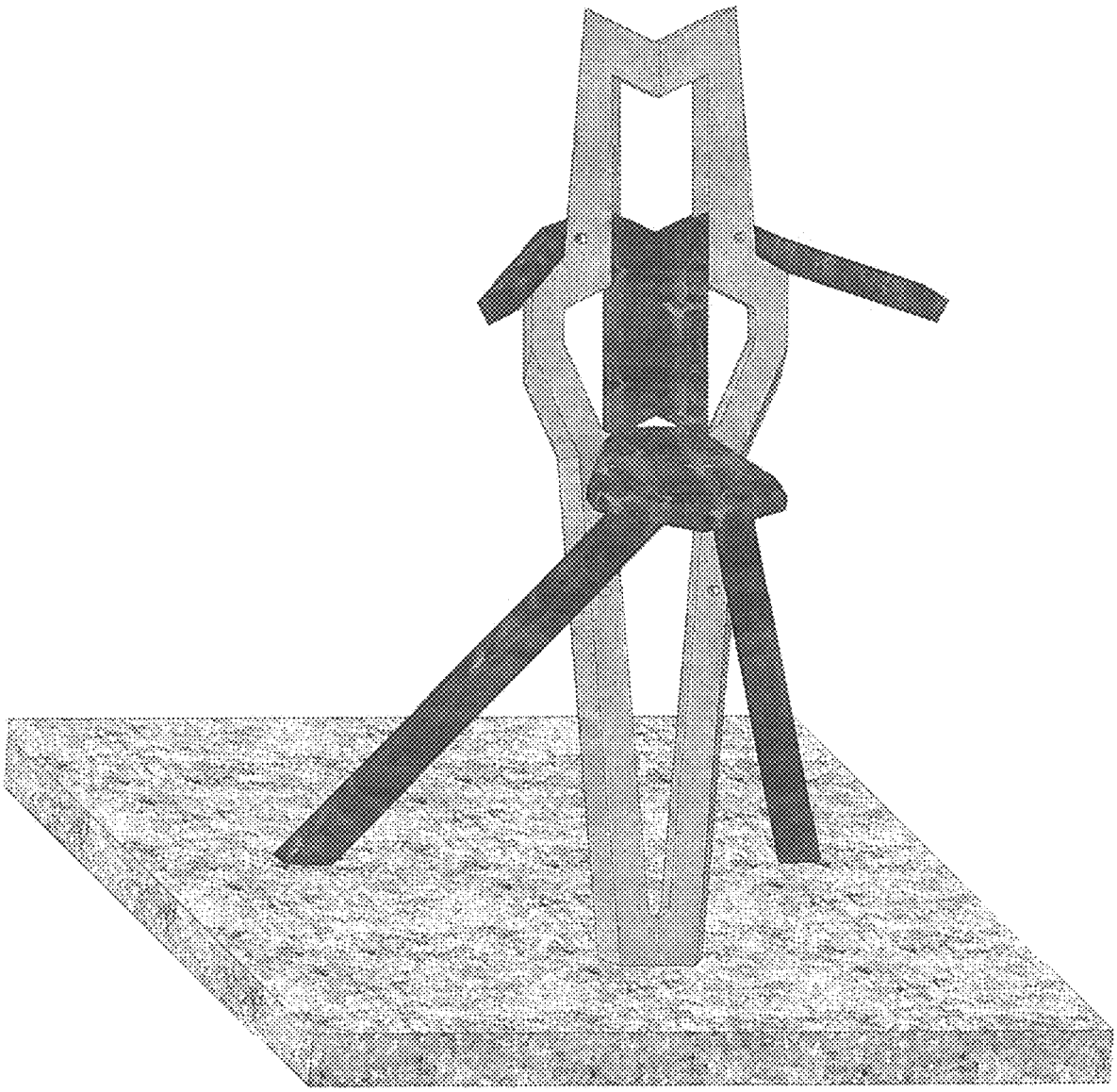
Figure 28:
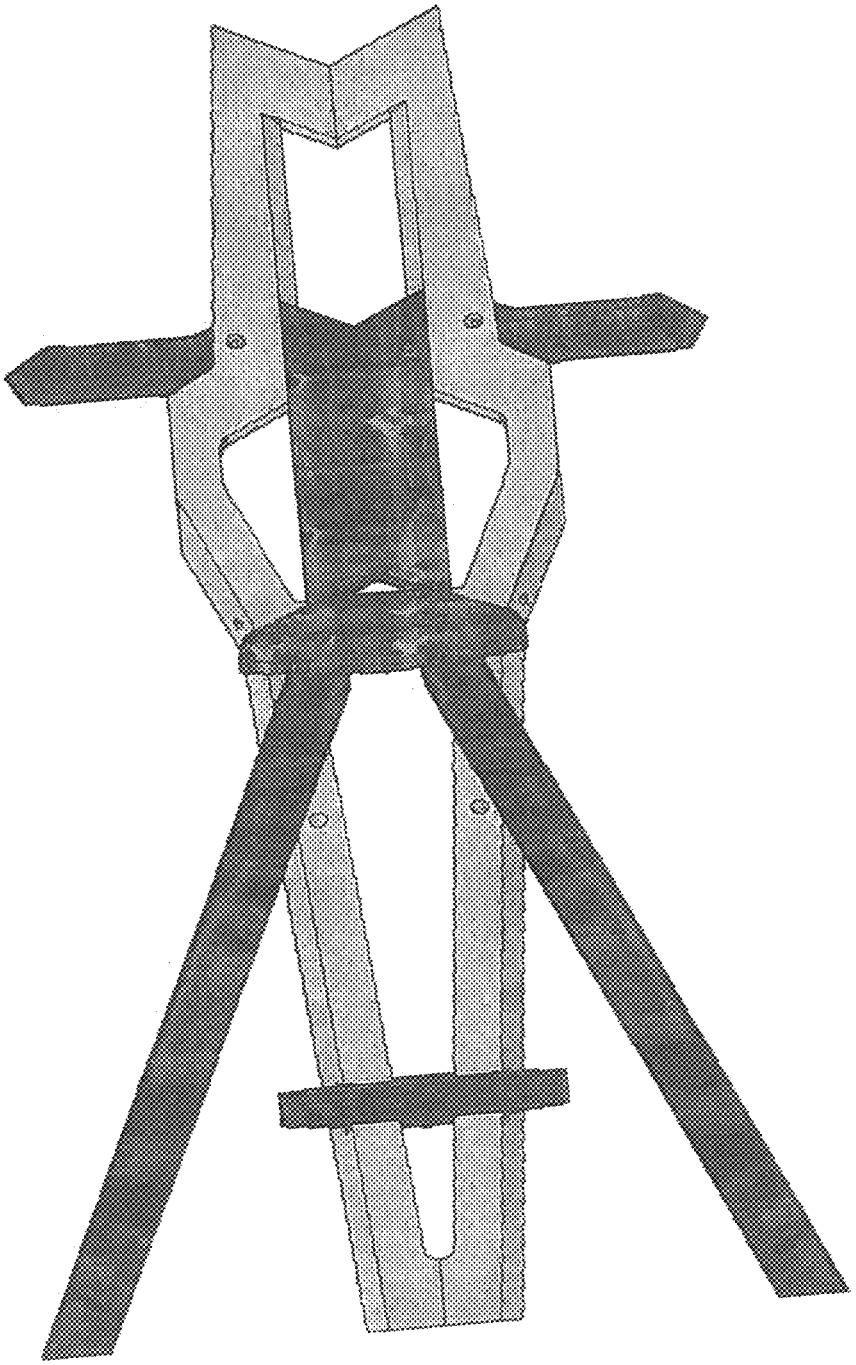
Figure 29:
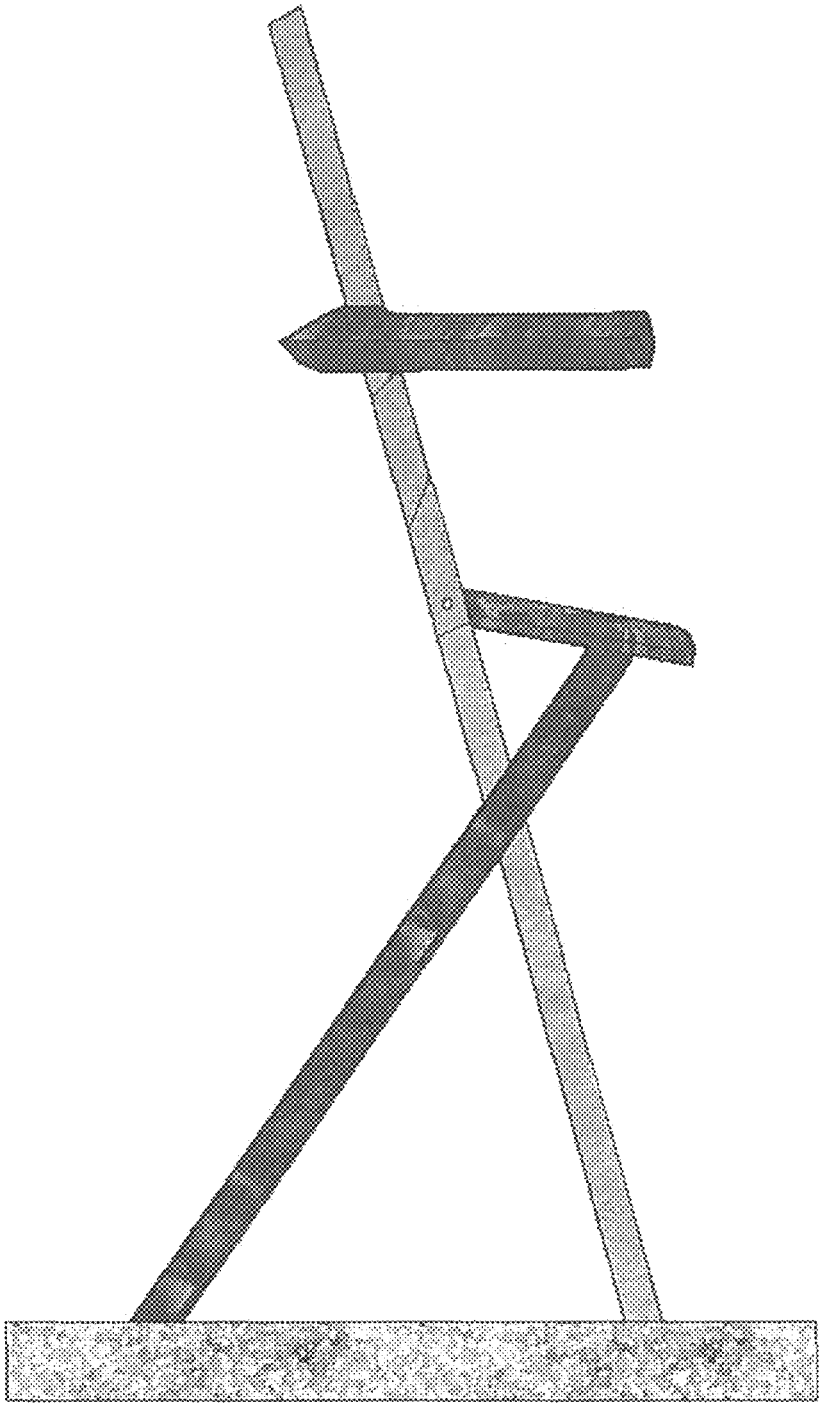
Figure 30:
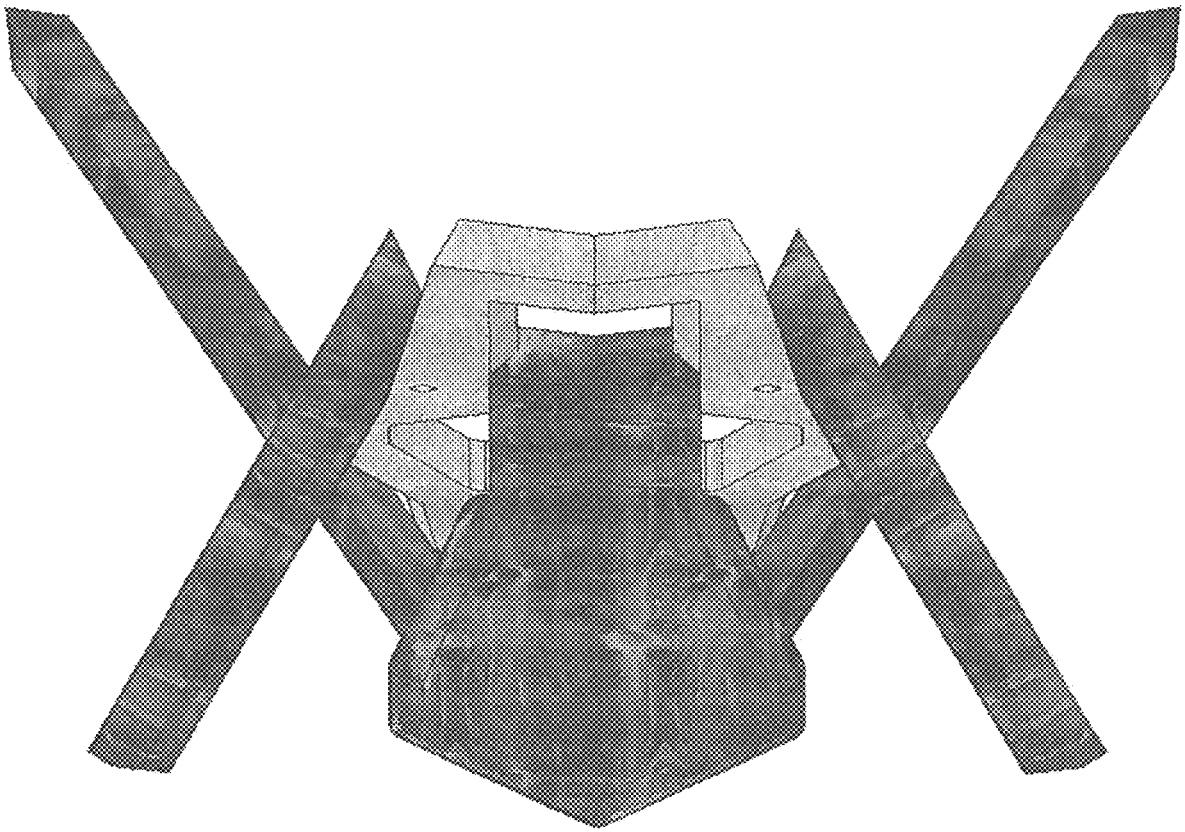
Figure 31:
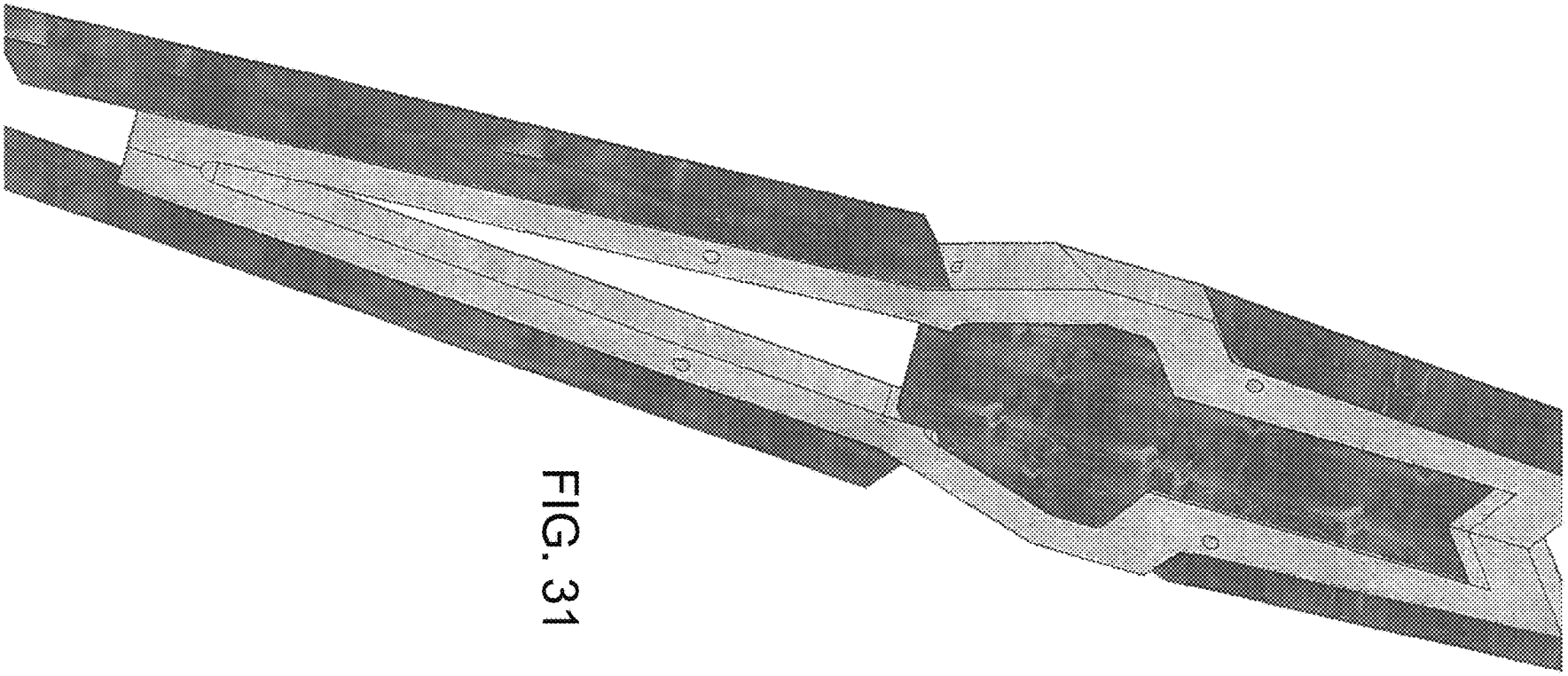
Figure 32:
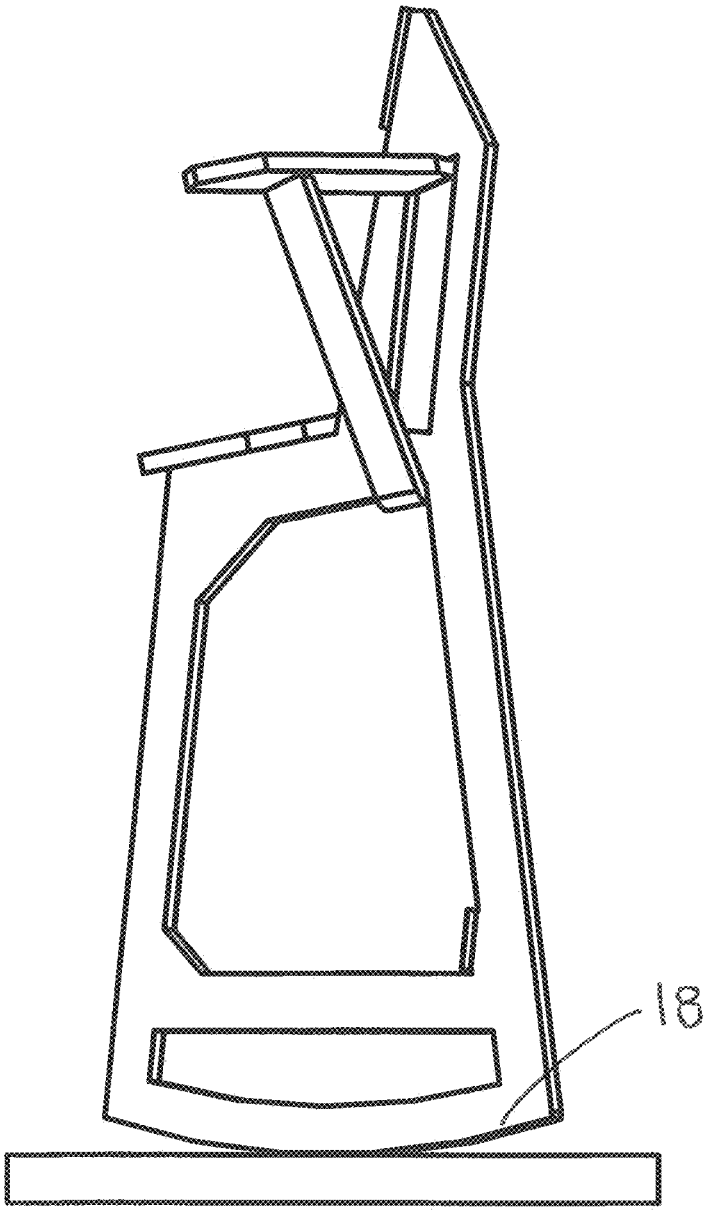
FIG. 32 is a side view of the chair in accordance with another alternate embodiment of this invention, this embodiment being similar to the chair of FIG. 19, and further comprising arcuate rails connecting the front leg to the rear legs, thus creating a "rocking-chair" configuration.

The significant components of the various configurations of the invention are shown notionally and numerically labeled. The dimensional ranges associated with the most significant geometric features are shown. All dimensions are approximate. Directions of motion associated with folding versions of the chair are also shown. Ordinary and inconsequential components such as fasteners and connecting hardware, that would be obvious to an individual skilled in the art, have been omitted for clarity. Descriptions of the numerical label are as follows:

1. Rear Legs
2. Front Leg
3. Upper Frame (an extension of the front leg 2.)
4. Backrest
5. Armrest
6. Seat (aka Saddle)
7. Footrest
8. Adjustment Holes (or slots)
9. Hinge Pins (scissor-type)
10. Backrest (flexible)
11. Hinge (barrel-type)
12. Fastener (fixed type)
13. Joint (fixed)
14. Integrated Front Leg, Seat, Upper Frame, and Backrest
15. Integrated Front Leg, Rear Legs, Front/Rear Leg Connector, and Upper Frame
16. Rear Leg to Rear Leg Connector
17. Armrest
18. Rocking Chair Rails
19. Overall Width Dimension
20. Overall Depth Dimension
21. Height at Front of Seat
22. Downward Slope Angle of the Seat
23. Height of the Armrest
24. Overall Height
25. Reaction Forces at Floor
26. Force Loads applied to Seat, Backrest, and Armrests
27. Center of Gravity and location of users Sitz Bones (approximate)
28. Cutout for Armrest (while nesting in folded position)
29. Front/Rear Leg Connector and Footrest
30. Direction of Rotation of Rear Leg (while folding)
31. Direction of Rotation of Front/Rear Leg Connector (while folding)
32. Direction of Rotation of Seat (while folding)
33. Direction of Rotation of Armrest Support (while folding)
34. Desktop/Work Surface
35. Angle Between Spine and Thighs while Perched in Sit/Stand Position
36. Direction of Rotation of Armrest Support (while folding)
37. Forward/Rearward Seat Pivot Feature
38. Range of Motion of Seat Pivot (from Horizontal Reference)
39. Pivot Adjustment and Locking Feature

DETAILED DESCRIPTION OF THE INVENTION AND PREFERRED EMBODIMENTS THEREOF

In the preferred embodiment a lightweight three-legged space-frame type structure, elegantly integrated with a seat and backrest in a unique minimalistic design configuration with exceptional structural efficiency is provided by means of triangulated connections between members. In a folding embodiment scissor-type hinge joints and barrel-type hinge connections enabling the chair members of a predetermined size and cross-sectional shape to be sequentially folded into a compact nested bundle, thus maximizing portability, carrying convenience, storage efficiency, and overall utility in a design of unparalleled novelty In a secondary alternate embodiment, the novel invention features a panel-type frame structure wherein exceptional structural efficiency is provided by a panel-type construction with a minimum number of components, and the load-bearing members arranged in triangulated pyramidal architecture. In a folding version of this panel-type design barrel-type hinge connections enabling the predominantly flat chair members to be sequentially folded into a compact flat form thereby maximizing portability, carrying convenience, storage efficiency, and overall utility.

Further, this invention includes means for adjustability of each of the support surfaces, to accommodate anatomical size and user preferences, as well as to promote comfort and good posture. The user may adjust the position base on their own personal estimation of fit and comfort, or they may follow recommended position guidelines derived from anthropometrics studies and established based on the user's height and gender, body mass index, or physical handicaps. Several embodiments of this invention enable complex folding and a broad range of adjustability by varying a combination of simple pivot locations, rotational positions, and lengths of the members that comprise this chair. The adjustments may be locked in position by any suitable means of retention. The particular means by which these adjustable and lockable functions may be achieved are well known and obvious to those skilled in the art.

Optionally, the chair may be equipped with a footrest that may be adjustable and could fold out of the way when unwanted or for stowage. The invention may also have one or more of the legs equipped with wheels, casters or rocking members. Additionally, the invention also encompasses accessories such as desktop type work surface, which further contribute to the utility and comfort of the seating system and experience.

In another embodiment of the invention, the chair comprises means by which to enable a rocking motion. The rocking action may be achieved via a convention pair of curved rocking rails.

Additionally, any number of complimentary optional features and accessories may be incorporated into the design of the chair to increase the convenience or comfort or utility. Such accessories may include wheels or casters, carrying handles or slings, stowage cases straps or hangers. A particularly useful accessory for the invention, comprises, an armrest with an integrated desktop type surface could be used to support reading and writing materials, as well as tablet and laptop computers. The chair may be equipped with provisions to accommodate any number of critical everyday carry items such as smartphones, food, and beverages. For example, the chair may be equipped to hold a fishing rod or hunting implement.

Several design variations, methods, materials, and functional elements associated with the construction of the invention, some of which are presented hereafter.

Fabric type materials would be suitable for constructing certain elements of the invention. The seat, backrests, and armrests may be comprised of any suitable material including fabric, webbing, rope, mesh, belting, leather, polymer, composite, or foam. Contact surfaces may be contoured to distribute the force on the user's anatomy thereby reducing pressure and increasing comfort. The surfaces that contact and support the user may be filled with any suitable cushioning materials such as such as foams, memory foam, gels, air, or granular filling. The seating surfaces may be textured to resist slippage and insulated to conserve heat, or vented to promote cooling.

Alternately, the seating members may comprise of bow-type structural members that are axially stiff, yet relatively flexible in bending along at least one axis. By adjusting the constraint conditions and preload on these bowed elements, the shape and stiffness of the chair may be permanently or adjustably manipulated. Moreover, the ends of the bowed elements may also be cantilevered out beyond the supports wherein their bending stiffness is reduced. The bowed elements may be sized, shaped, and formed to maximize comfort or style. Any number of relatively strong and stiff materials such as fiber-reinforced composites, spring-steel, plastic, metal, or wood, would be suitable for construction of these bowed elements.

While this invention can be executed any number of suitable materials, extruded custom or stock aluminum profiles in particular, are ideal for the design and construction of many of the required components Aluminum is provides good combination of strength, lightweight, corrosion resistance, machinability, and relatively low cost. Similarly, fiberglass reinforced structural composite materials can be produced the form of custom profiles via a pultrusion process. Custom aluminum or fiberglass profiles may provide many advantages. The exterior and interior profile features can be specifically designed for receiving hardware for interconnecting the chair members and or for mounting accessories.

Aluminum profile can be rolled, bent, or formed into curved members. However, in an alternate method of construction method, the profiles comprising the frame structure may be segmented at angles. The segments may be arranged in order to introduce a form fitting curvature to the structure. One method comprises the use of a reinforcing member such as a wire rope or cable. The cable provides both an axial alignment means as well as a tensioning capability which intern provides a flexural stiffening effect on the member. In another embodiment of the invention, the angular relationship between the segments may be varied or adjusted by using wedged or adjustable spacer inserts. In the above arrangement, the segments act in a manner analogous to the vertebrae in a spine, while the reinforcing members act in a manner analogous to a structurally significant spinal cord.

Telescoping structural tubing could be utilised to enable adjustability and provides the ability to minimise size in the folded or stowed condition. The telescoping members may adjusted by locking collet-type clamps. Alternately, the telescopic or male/female tube members may feature detent holes with button-type locking means or adjustable position pins. The telescopic members may be circular or of the non-circular non-rotating type that would enable the members to support of torsional loads and may also be held together by means of an in internal bungee-cord in a shock-pole configuration.

Alternately, the chair could be formed or molded from plastic resins, composites, or vacuum formed from thermoplastic sheet stock. Similarly, the chair may be formed, welded, or rigidly bolted from metal. By eliminating the need for the pivoting joints in the rigid non-folding embodiments of the invention, the structure of the chair is transformed from a three dimensional linkage to a structurally superior three-dimensional space frame.

With respect to connecting hardware, rigid or semi-rigid locking features may be integrated into the design enabling the individual components of the chair to be secured in both the folded and unfolded condition. Custom hinged and rotating joints could be used to maximize strength and minimize the stresses on the structural members of the chair. Elastomeric bearing may be integrated into the joints to absorb shock and distribute force, while also pre-tensioning the critical hinge joints.

I claim:

1. An ergonomic chair having an inclined seat to accommodate a user for sitting in a substantially upright sit/stand position in which the user's weight is distributed between their feet and buttocks while perching on said inclined seat, said chair having a four-legged space-frame type structure with a seat and backrest comprising:

first and second elongated rectilinear front-leg/chair-back members each having an axis and each having first and second axial extremities, the axis of said first and second elongated rectilinear front-leg/chair-back members being coplanar in a first plane, said first plane being disposed in oblique relation to an associated horizontal floor surface, said first axial extremities of said first and second elongated rectilinear front-leg/chair-back members being proximate to each other on an associated floor when the chair is unfolded and resting on the associated floor and said second axial extremities of said first and second elongated rectilinear front-legs/chair-back members being spaced apart;

a planar backrest fixed intermediate said second axial extremities of said first and second elongated rectilinear front-leg/chair-back members, said planar backrest being aligned with said first plane;

said chair further including first and second elongated rectilinear rear chair leg members disposed in oblique relationship to an associated horizontal floor surface, said first and second elongated rectilinear rear chair leg members respectively having a first axis and a second axis and first and second axial extremities, said first and second axis of said first and second elongated rectilinear rear chair leg members being coplanar, said first axial extremities of said first and second elongated rectilinear rear chair leg members resting on an associated floor when the chair is unfolded and supported by the associated floor, said first extremities of said first and second elongated rectilinear rear chair leg members being spaced further apart than said second extremities of said first and second elongated rectilinear rear chair leg members;

said first elongated rectilinear rear chair leg being pivotally connected to said first elongated rectilinear front-leg/chair-back member intermediate said first and second axial extremities and disposed in oblique relationship to said first elongated rectilinear-front leg/chair-back member;

said second elongated rectilinear rear chair leg being pivotally connected to said second elongated rectilinear front-leg/chair-back member intermediate said first and second axial extremities and disposed in oblique relationship to said second elongated rectilinear-front leg/chair-back members;

said chair further including a planar seat, said seat having first and second sides disposed intermediate said first and second elongated rectilinear front-leg/chair-back members and having said first and second sides respectively pinned to said first and second elongated rectilinear front-leg/chair-back members thereby allowing relative rotary motion therebetween, said seat having a front edge and a back edge, said front edge being at a lower elevation than said rear edge; said seat selectively engaging said second axial extremity of each of said first and second elongated rectilinear front-leg/chair-back members, said seat being foldable by disengagement from said second axial extremity of said first and second-leg/chair-back members and pivotal movement with respect to said first and second elongated rectilinear front-leg/chair-back members whereby, (1) said first axial extremities of said first and second elongated rectilinear front-leg/chair-back members being proximate to each other when said chair is unfolded and sitting on an associated floor, said first axial extremities of said first and second elongated rectilinear front-leg/chair-back members effectively function as a single point of a stable 3 point triangular base in combination with said first axial extremities of said first and second elongated rectilinear rear chair leg members resting on an associated floor when the chair is unfolded and (2) said chair will fold into a bundle with at least said first and second elongated rectilinear front-leg/chair-back members and said first axial extremities of said first and second elongated rectilinear rear chair leg members disposed in parallel side abutting relationship.

2. The ergonomic chair as described in claim 1 further including first and second elongated rectilinear armrest members each having first and second axial extremities, said first axial extremity of said first elongated rectilinear arm rest member being pinned to said first front-leg/chair-back member, said first axial extremity of said second elongated arm rest member being pinned to said second front-leg/chair-back member, said first elongated rectilinear arm rest members being supported in a substantially horizontal orientation, when said ergonomic chair is unfolded, by a first arm rest support member extending from said first arm rest to a pinned connection to said first front-leg/chair-back member, said second elongated rectilinear arm rest members being supported in a substantially horizontal orientation, when said ergonomic chair is unfolded, by a second arm rest support member extending from said second arm rest to a pinned connection to said second front-leg/chair-back member.

* * * * *